United States Patent [19]

Diederich et al.

[11] 4,416,586

[45] Nov. 22, 1983

[54] SUBMERSIBLE MOTOR PUMP ASSEMBLY

[75] Inventors: Herbert Diederich, Frankenthal; Karl Gaffal, Hessheim; Hugo Scherzer, Heidelberg-Rohrbach, all of Fed. Rep. of Germany

[73] Assignee: Klein, Schanzlin & Becker Aktiengesellschaft, Frankenthal, Fed. Rep. of Germany

[21] Appl. No.: 252,584

[22] Filed: Apr. 9, 1981

[30] Foreign Application Priority Data

Apr. 19, 1980 [DE] Fed. Rep. of Germany ..... 3015211

[51] Int. Cl.[3] ..... F04B 49/10; F03B 11/00

[52] U.S. Cl. ..... 417/13; 415/169 A; 417/370; 417/424

[58] Field of Search ..... 417/12, 13, 313, 424, 417/360, 369, 370; 210/222, 168; 415/168, 121 A, 169 A, 110–113; 184/1 E, 6.21, 6.25

[56] References Cited

U.S. PATENT DOCUMENTS

| | | | |
|---|---|---|---|
| 2,758,226 | 8/1956 | Fisher | 417/13 |
| 3,186,513 | 6/1965 | Dunn et al. | 415/111 |
| 3,195,467 | 7/1965 | Collet | 417/420 |
| 3,558,238 | 1/1971 | Van Herpt | 415/169 A |
| 3,746,350 | 7/1973 | Mayer et al. | 415/169 A |
| 4,037,985 | 7/1977 | Karassik et al. | 415/169 A |
| 4,190,538 | 2/1980 | Chen | 417/370 |

FOREIGN PATENT DOCUMENTS

| | | | |
|---|---|---|---|
| 1025281 | 1/1978 | Canada | 417/424 |
| 541501 | 3/1977 | U.S.S.R. | 210/222 |

*Primary Examiner*—Carlton R. Croyle
*Assistant Examiner*—Timothy S. Thorpe
*Attorney, Agent, or Firm*—Kontler, Grimes & Battersby

[57] ABSTRACT

A submersible motor pump assembly has a motor which is installed at a level below the pump. The shaft which is driven by the motor and rotates the impeller or impellers of the pump is spacedly surrounded by a tubular member of a thermal barrier in the region between the upper end of the motor housing and the lower end of the pump casing. The solid impurities, especially magnetizable particles, which are circulated by the pump tend to penetrate into the motor housing by way of the clearance between the tubular member and the shaft, and the penetration of such impurities into the motor housing is prevented by an apparatus which conveys a stream of liquid from the discharge nozzle of the pump casing into the clearance and contains a filter with several electromagnets which intercept magnetizable particles and allow a clean stream of flushing liquid to flow into the clearance. A portion of the liquid stream which is admitted into the container of the filter and is laden with intercepted and/or non-segregated impurities is returned into the interior of the pump casing by way of channels which are machined directly into the tubular member and discharge contaminated liquid into the range of impeller means in the pump casing. The electromagnets of the filter can be energized independently of each other and are normally energized for a given interval of time including a period prior to starting of the motor and a period following the starting and corresponding to the period of run-up of the motor.

18 Claims, 4 Drawing Figures

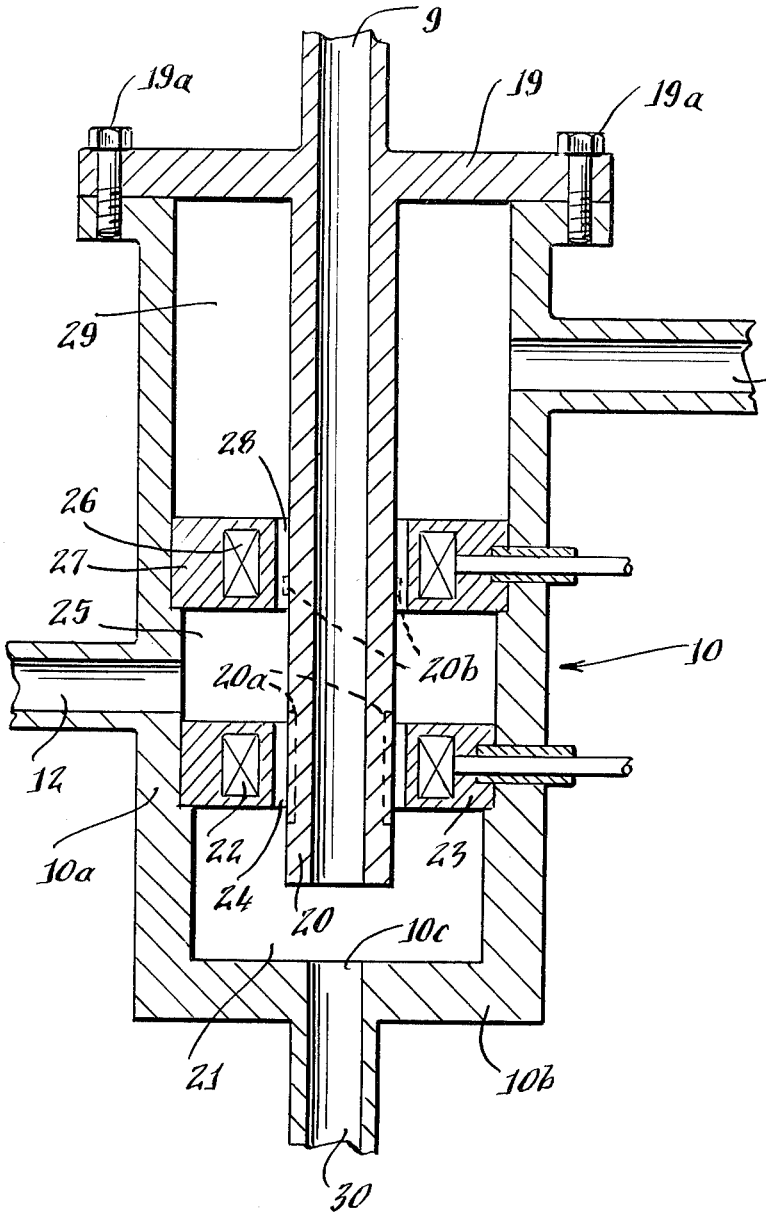
Fig. 3.
Fig. 4.
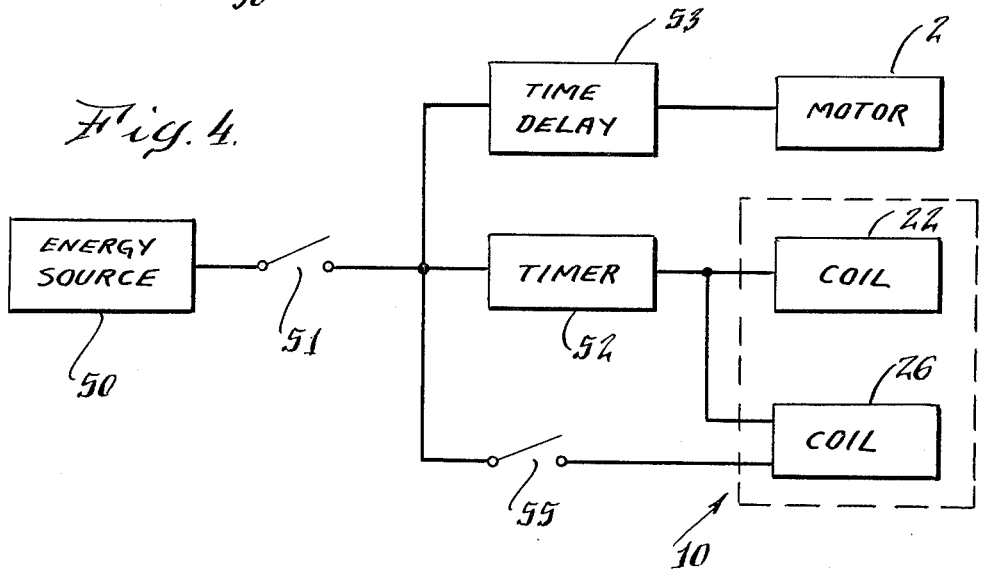

SUBMERSIBLE MOTOR PUMP ASSEMBLY

BACKGROUND OF THE INVENTION

The present invention relates to submersible motor pump assemblies, namely, to assemblies wherein the pump casing and the motor housing are flooded with liquid which is conveyed by the pump. More particularly, the invention relates to improvements in apparatus for preventing penetration of solid impurities into the housing of the submersible motor (also called underwater motor or U-motor if the conveyed liquid is water), especially during starting and acceleration of the motor to normal operating speed.

It is already known to construct submersible motor pump assemblies (hereinafter called assemblies for short) in such a way that the pump casing and/or the motor housing provides a path for the flow of liquid from the casing into the housing. The path normally includes an annular clearance between a tubular member, which connects the casing with the housing, and the peripheral surface of the pump shaft which latter is driven by the motor and transmits torque to the impeller or impellers of the pump. In other words, the just described conventional assemblies do not employ a stuffing box around the pump shaft in the region between the impeller or impellers of the pump and the stator of the motor. Such assemblies can be used for circulation of liquid in a boiler. It is also known to provide a conventional assembly with means for directing a stream of flushing liquid from the interior of the motor housing toward the interior of the pump casing so that the stream prevents penetration of solid impurities into the motor. As a rule, the flushing liquid is pure cool water so that such liquid can serve the additional purpose of preventing overheating of the motor. In many instances, the stream of flushing liquid is caused to flow from the motor housing toward and into the casing of the pump only during starting of an assembly wherein the pressure of pumped liquid during starting is relatively low. However, it is also known to operate with a stream of flushing liquid in assemblies wherein the pressure of pumped liquid is high or relatively high in the course of the starting operation. One of the presently accepted classifications of pumps according to pressure is that between high-pressure pumps with a nominal total head between 200 and 1200 m, low pressure pumps with a nominal total head not exceeding 80 mm, medium-pressure pumps with a nominal total head ranging between 80 and 200 m, and very-high-pressure pumps with a nominal total head in excess of 1200 m. When the total head is relatively low, the flushing liquid can be furnished by the condensate conveying system. When the total head is higher and the flushing is to take place at elevated pressures, flushing liquid is supplied by the boiler feed pump. Since the permissible operating temperature of the motor is limited, flushing liquid which is supplied by a boiler feed pump must be cooled prior to admission into the motor housing; furthermore, such liquid must be cleaned in order to ensure that it does not entrain solid or other impurities into the interior of the motor.

A drawback of the above-described and other apparatus for preventing penetration of solid impurities into the motor housing of an assembly is that they are complex and expensive. Thus, such apparatus necessitate the utilization of pipelines, valves, cooling systems and filters. Furthermore, conventional apparatus for preventing penetration of solid impurities into the motor housing are far from being foolproof, i.e., they are highly likely to permit contamination of the motor housing in the event of a malfunction of the assembly and/or when the assembly is operated by an unskilled, semiskilled or careless attendant. Penetration of solid impurities into the motor housing is highly likely to entail rapid destruction of or, at the very least, extensive damage to component parts (especially bearings) of the motor.

The likelihood of damage to component parts of the motor in a submersible motor pump assembly is especially pronounced when the pump shaft is vertical and the motor is installed at a level below a centrifugal pump. Such assemblies are often utilized in boiler plants. Solid impurities, especially products of corrosion consisting of or containing a high percentage of magnetite, are highly likely to be circulated by the pump during starting as well as subsequent to testing of the boiler plant. The increased percentage of magnetite and/or other impurities in the pump circuit during the just mentioned stages of operation of the assembly is highly likely to entail contamination of the motor, especially since the assembly is normally located at the lowermost point of the closed system for circulation of the fluid to be pumped. Thus, when the motor is turned off, corrosion products tend to migrate toward and to accumulate, in large quantities, in the casing of the centrifugal pump forming part of the motor pump assembly. When the motor is started again, a substantial percentage of solid impurities which have accumulated in the pump casing is likely to penetrate into the motor housing barring effective measures for prevention of contamination of the motor. In the absence of such measures, the motor housing is contaminated in the following way:

The pump establishes or develops a pressure differential between the interior of the pump casing and the interior of the motor housing in response to starting of the motor. The pressure in the interior of the pump casing rises and propagates into the clearance between the interior of the pump casing and the interior of the motor housing. As explained above, the just mentioned clearance is formed between the internal surface of a sleeve-like or tubular portion of the pump casing or motor housing (i.e., a portion of the housing or enclosure of the assembly) and the peripheral surface of the pump shaft which extends from the housing of the motor and upwardly into the interior of the pump casing to drive the impeller means of the pump. Even though the motor is normally provided with automatic air evacuating means or is designed with a view to exhibit a self-venting feature, at least some air is highly likely to remain entrapped between the motor winding and the package of stator laminations. Such residual air is compressed in response to rising pressure in the pump casing and the propagation of pressure into the motor housing by way of the clearance around the pump shaft. This enables a certain quantity of liquid (namely a quantity filling a volume corresponding to that by which the volume of entrapped or residual air is compressed in the interior of the motor housing) to penetrate into the motor housing. The liquid which flows into the motor housing is laden with solid impurities, i.e., such impurities penetrate into the interior of the motor housing and can lead to serious damage to or total destruction of bearings and/or other component parts of the motor.

The pressure differential between the interior of the pump casing and the interior of the motor housing is reduced to zero only after the impeller means of the pump rotates at the normal or full speed, i.e., when the air compressing step is terminated. In other words, liquid ceases to flow from the pump casing into the motor housing only with a certain delay after starting, i.e., when the RPM of the pump shaft has risen to the maximum value.

OBJECTS AND SUMMARY OF THE INVENTION

An object of the invention is to provide a submersible motor pump assembly which is constructed and can be operated in such a way that the likelihood of penetration of solid impurities during any state of operation of the assembly is much less pronounced than in heretofore known assemblies.

Another object of the invention is to provide the assembly with an automatic apparatus for prevention of penetration of impurities into the motor housing so that the assembly cannot permit contamination of the interior of the pump housing as a result of improper manipulation of its controls or other components.

A further object of the invention is to provide a simple, compact, rugged and reliable apparatus for preventing penetration of magnetite and/or other solid impurities from the interior of the pump casing into the interior of the motor housing in an assembly of the above outlined character.

An additional object of the invention is to provide an assembly wherein the apparatus for preventing penetration of impurities into the motor housing is or can be permanently installed in the assembly so that the heretofore necessary connections or auxiliary aggregates which are used to prevent or to reduce the likelihood of penetration of solid contaminants from the pump casing into the motor housing can be dispensed with.

Still another object of the invention is to provide the assembly with novel and improved means for intermittent evacuation of intercepted contaminants.

A further object of the invention is to provide the assembly with a novel and improved apparatus for preventing penetration of magnetizable impurities into the motor housing.

An additional object of the invention is to provide a novel and improved apparatus for preventing penetration of impurities into the motor housing of a submersible motor pump assembly and to construct and assemble the apparatus in such a way that it can be readily installed in many presently known or used submersible motor pump assemblies.

The invention is embodied in a submersible motor pump assembly for the circulation of a liquid (e.g., water in a boiler plant) which contains solid impurities, particularly impurities including or consisting of magnetizable material. The assembly comprises a pump having a casing with discharge means (e.g., a nozzle) for pressurized liquid, a motor which is preferably installed at a level below the pump and has a housing as well as a rotary shaft serving to drive the pump, a device (e.g., a thermal barrier) defining with the shaft a clearance communicatively connecting the interior of the pump casing with the interior of the motor housing, and an apparatus for preventing penetration of impurities from the pump casing, via the clearance between the aforementioned device and the shaft, and into the motor housing. The apparatus comprises liquid conveying means (e.g., one or more pipes, conduits, channels, bores or the like) defining a path for the flow of at least one stream of liquid from the discharge means of the pump casing into the clearance, and filter means provided in the path to intercept impurities in the stream of liquid entering the path so that the conveying means delivers to the clearance a stream of flushing liquid which is at least substantially free of impurities.

The aforementioned device has an internal surface (such device may include a tubular member rigidly connected with the pump casing and with the motor housing and forming therewith a composite enclosure of the submersible motor pump assembly) which spacedly surrounds the shaft intermediate the pump casing and the motor housing. The internal surface has at least one groove which receives the stream or streams of flushing liquid from the filter means.

The apparatus preferably further comprises means for returning a portion of the liquid which is admitted into the path, and contains some or all of the intercepted impurities, directly into the interior of the pump casing. The returning means may comprise one or more channels or bores which are machined into or otherwise formed in the aforementioned tubular member and preferably discharge contaminated liquid into the range of impeller means in the interior of the pump casing so that the impeller means can direct the returned liquid into the discharge means.

If the impurities consist of or contain a relatively high percentage of magnetizable particles, the filter means preferably includes a magnetically operated filter which is designed to attract and thus intercept magnetizable impurities in the path defined by the improved apparatus. The magnetically operated filter can comprise a container and a plurality of electromagnets installed in the container and defining a series of successive passages for the flow of liquid from the discharge means toward the clearance so that each of the electromagnets can attract some magnetizable impurities during flow of the liquid through the respective passage. The electromagnets preferably include a first electromagnet and a second electromagnet which latter is disposed downstream of the first electromagnet, as considered in the direction of flow of liquid along the aforementioned path. The container has an internal space including a region or zone intermediate the passages which are defined by the first and second electromagnets, and the aforementioned returning means is preferably designed to convey a portion of the liquid from the intermediate region directly into the interior of the pump casing. The remaining portion of liquid which is admitted into the container flows through the passage which is defined by the second electromagnet and thence into the clearance between the shaft and the aforementioned tubular member.

The apparatus preferably further comprises means (e.g., a suitable timer) for energizing the electromagnets for a predetermined interval of time and for starting the motor with a predetermined delay following energization of the electromagnets. The interval includes a first period preceding starting of the motor and a second period following starting of the motor and preferably matching or approximating the period of run-up of the motor. Still further, the apparatus preferably comprises means for energizing at least one of the electromagnets independently of the other electromagnet or electromagnets.

The path portion upstream of the filter may comprise valve means (e.g., a solenoid-operated valve) which is operative to admit liquid into the filter means only while the filter means is activated.

The bottom portion of the aforementioned container of the filter means is preferably provided or associated with means for permitting evacuation of impurities from the interior of the container and through the bottom portion. Such evacuating means may comprise a draining pipe connected to or integral with the bottom portion of the container and a shutoff valve in the draining pipe.

Still further, the apparatus can comprise means for directing liquid which enters the aforementioned clearance toward the interior of the pump casing. Such directing means can comprise an external thread on the shaft and/or a thread provided in the internal surface of the tubular member forming part of the aforementioned device which cooperates with the shaft to define the clearance around the shaft portion intermediate the pump casing and the motor housing.

The novel features which are considered as characteristic of the invention are set forth in particular in the appended claims. The improved assembly itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a greatly enlarged central vertical sectional view of a filter in the structure of FIG. 2; and FIG. 4 is a diagram of a presently preferred circuit including the motor and the electromagnets of the filter shown in FIG. 3.

DESCRIPTION OF THE PREFERRED EMBODIMENTS

Figure 1:
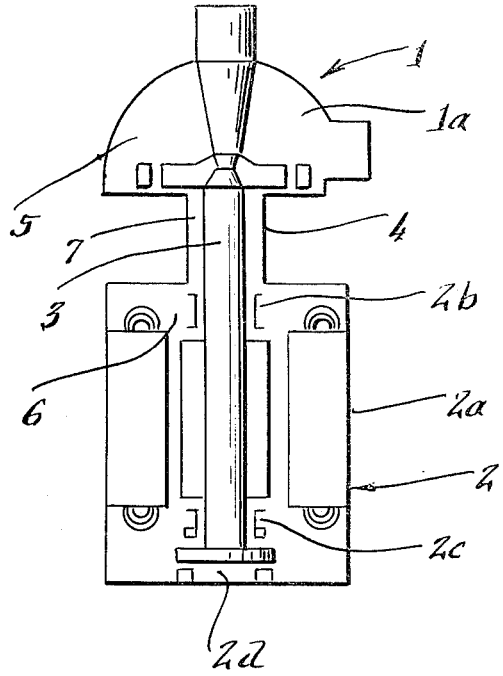
FIG. 1 is a schematic axial sectional view of a submersible motor pump assembly which embodies one form of the invention.

The submersible motor pump assembly which is shown in FIG. 1 comprises a centrifugal pump 1 which is located at a level above a motor 2. The motor 2 drives a shaft 3 which rotates the impeller 17 (see FIG. 2) of the pump 1. The reference character 4 denotes a device including a thermal barrier which is interposed between the casing 1*a* of the pump 1 and the housing 2*a* of the motor 2. This heat barrier includes a tubular portion 4*a* which spacedly surrounds the adjacent portion of the shaft 3 so that the parts 3 and 4*a* define an annular clearance or gap 7. The lower end of the clearance 7 communicates with the internal space or chamber 6 of the motor 2, and the upper portion of the clearance 7 communicates with the adjacent portion of the internal space or chamber 5 of the centrifugal pump 1. The housing 2*a* contains bearings 2*b*, 2*c*, 2*d*, for the shaft 3.

The discharge nozzle 8 of the pump casing 1*a* communicates with a downwardly extending supply conduit 9 which diverts a relatively small stream of circulated fluid into a filter 10 here shown as a magnetically operated filter. However, it is equally possible to employ other types of non-clogging filters, e.g., cyclone separators or equivalent means for mechanically segregating solid impurities from a stream of liquid medium.

The filter 10 has a first outlet in the form of a pipe or conduit 11 serving to convey a stream of cleaned flushing liquid (e.g., water) into the clearance 7 for admission into the motor chamber 6, and a second outlet in the form of a pipe or conduit 12 serving to return contaminated liquid (i.e., a stream of liquid which is laden with impurities including those removed from the liquid flowing in the outlet or pipe 11) back into the chamber 5 of the pump 1. The discharge end of the pipe 11 communicates with a radial channel or bore 13 provided in the tubular member 4*a* of the heat barrier 4, and the inner end portion of the channel 13 delivers cleaned flushing liquid into a circumferentially complete groove 14 machined into the internal surface of the tubular member 4*a*. The groove 14 communicates with the clearance 7.

The discharge end of the pipe or conduit 12 admits impurities-containing liquid into a radially extending bore or channel 15*a* of the tubular member 4*a*, and the discharge end of the channel 15*a* admits liquid into an axially parallel bore or channel 15 discharging into the portion 16 of the pump chamber 5. The portion 16 is adjacent to the impeller 17 of the pump 1. When the impeller 17 rotates, i.e., when the motor 2 is on to drive the shaft 3, the impeller 17 draws liquid from the portion 16 of the pump chamber 5 and conveys such liquid (together with the impurities contained therein) into the endless path wherein the liquid circulates under the action of the pump 1.

Figure 2:
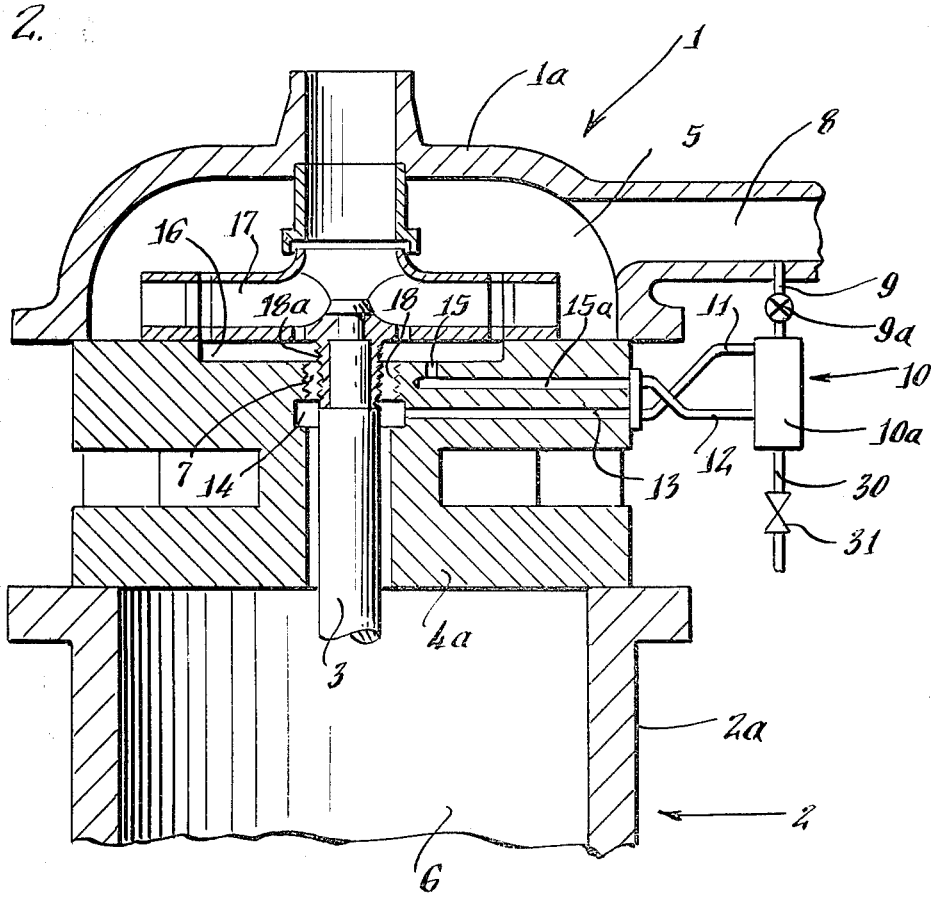
FIG. 2 is an enlarged fragmentary view of the upper portion of the structure shown in FIG. 1.

The structure which is shown in FIG. 2 embodies an optional auxiliary liquid directing feature which serves to ensure that the liquid which is supplied via channel 15 will not flow downwardly and into the clearance 7. This liquid directing feature includes the provision of internal threads 18 in that portion of the internal surface of the tubular member 4*a* which is disposed between the groove 14 and the portion 16 of the pump chamber 5, and the provision of external threads 18*a* on the adjacent portion of the shaft 3. The threads 18 and 18*a* define helical grooves for the flow of liquid upwardly toward and into the portion 16 of the pump chamber 5.

The magnetically operated filter 10 is shown in detail in FIG. 3. It comprises a container 10*a* having a main portion and a separable cover or lid 19 secured to the main portion by screws 19*a* or other suitable fastener means. The cover 19 is integral with or separably connected to the lower end portion 20 of the supply conduit 9. The end portion 20 extends well into and close to the bottom wall 10*b* of the container 10*a* of the filter 10; this end portion constitutes the core of two electromagnets which are installed in the container 10*a* at different levels and respectively comprise d-c coils or windings 22 and 26. The end portion 20 discharges contaminated liquid into the bottom region or zone 21 of the internal space of the container 10*a*. The coil 22 is installed in a holder 23 which is secured to the container 10*a* and spacedly surrounds the end portion or core 20 so that the parts 20 and 23 define an annular passage 24 for the flow of liquid from the bottom region 21 into an intermediate region or zone 25 communicating with the pipe 12. The holder 23 preferably constitutes a hermetically sealed pressure-resistant capsule so that it can accept and safely confine a coil (22) which is capable of withstanding elevated temperatures.

The coil 26 is installed and encapsulated in a second annular holder 27 mounted in the container 10*a* at a level above the intermediate region or zone 25 and separating the latter from a relatively large upper region or zone 29 which communicates with the inlet of the pipe 11. The holder 27 spacedly surrounds and defines with the end portion or core 20 an annular passage 28 for the flow of purified liquid from the intermediate region or zone 25 into the upper region or zone 29.

The bottom wall 10*b* of the container 10*a* has an opening 10*c* in communication with a draining pipe 30 which contains a shutoff valve 31 (see FIG. 2).

The operation of the submersible motor pump assembly of FIGS. 1 to 3 is as follows:

The discharge nozzle 8 of the pump casing 1*a* supplies a stream of contaminated pressurized liquid into the endless path for circulation of such liquid by the improved assembly. A portion of the stream flows into the path which is defined in part by the supply conduit or pipe 9 to enter the lowermost region or zone 21 of the container 10*a* by way of the axial bore in the end portion or core 20. The major percentage of impurities which, as a rule, are fragments of magnitite whose size is very or extremely small, is segregated from the liquid which flows from the region 21, through the passage 24 and into the intermediate region 25. The segregated impurities accumulate on the surfaces bounding the passage 24, i.e., on the end portion 20 and on the holder 23.

The liquid which flows into the intermediate region 25 above the coil 22 is divided into two streams in dependency on the pressure differential between the interior of the conduit 12 and the region 29. A first stream which normally, or at times, still contains a certain percentage of solid impurities flows into the conduit 12 to be returned into the portion 16 of the pump chamber 5 via channels 15*a* and 15. A second stream flows through the passage 28, into the region 29 and thence into the conduit 11. The magnetic field which is active in the passage 28 reliably removes any solid impurities which are entrained from the region or zone 25 toward the region 29 so that the latter is filled with cleaned flushing liquid which is admitted into the channel 13 and thence into the circumferentially complete groove 14 in the internal surface of the tubular member 4*a*.

The improved submersible motor pump assembly embodies or can embody additional safety features to even more reliably prevent the admission of solid impurities into the motor chamber 6.

First of all, the volume of the uppermost region or zone 29 in the container 10*a* of the filter 10 can be selected in such a way that the flow of liquid therethrough takes place at a rate which is a small fraction of the velocity of liquid in the groove 14, i.e., the region or zone 29 of the internal space of the container 10*a* is relatively large. This ensures that any solid particles which happen to enter the region 29 are accelerated not later than during flow in the groove 14 and are entrained upwardly, toward and into the portion 16 of the pump chamber 5, i.e., such particles are prevented from descending in the clearance 7 and from entering the motor chamber 6. The aforementioned liquid directing threads 18 and 18*a* contribute to the tendency of liquid which enters the groove 14 to flow toward the portion 16 of the pump chamber 5 rather than into the motor chamber 6.

The aforedescribed various means for preventing the penetration of solid impurities into the motor chamber 6 can be resorted to individually or in groups of two or more, depending on the desired degree of reliability of the apparatus which is to prevent penetration of solid matter into the motor 2. Still further, the assembly can be provided with a modified core 20 which defines a first passage with the lower coil 22 and a different second passage with the upper coil 26 of the filter 10. For example, the external surface of the core 20 can be formed with a circumferential groove or recess 20*a* which is surrounded by the holder 23 so that the effective cross-sectional area of the passage 24 then exceeds the cross-sectional area of the passage 28. In addition, the core 20 can be provided with a circumferentially complete or interrupted collar or flange 20*b* which is surrounded by the holder 27 and serves to reduce the effective cross-sectional area of the passage 28. Still further, the core 20 can be formed with two external grooves of different depths or with two external flanges of different outer diameters. The illustrated groove 20*a* and flange 20*b* are indicated by broken lines because they constitute optional features of the improved filter. The purpose of the groove 20*a* and flange 20*b* is to even more accurately select the pressure differences, velocities of liquid and filtering action in the container 10*a* by appropriately influencing the diameter and cross-sectional area of the passage 24 and/or 28.

In accordance with a further feature of the invention, the filter 10 is preferably activated only during certain stages of operation of the submersible motor pump assembly. This is especially desirable when the liquid entering the filter 10 via supply conduit 9 contains a high or very high percentage of magnetite and/or other magnetizable impurities which can be intercepted by electromagnetic means. The purpose of intermittent or short-lasting (in contrast to uninterrupted) operation or activation of the filter 10 is to prevent or reduce the likelihood of its clogging with intercepted contaminants when the percentage of impurities in the stream entering the container 10*a* via conduit 9 and core 20 is high or very high. The arrangement is then such that the coils 22 and 26 are energized during the run-up stage of the pump 1, i.e., during the stage which involves or is likely to involve some flow of liquid between the chambers 5 and 6 for reasons which were discussed hereinbefore. An electric circuit which ensures that the coils 22 and 26 are energized only during certain stages of operation of the assembly is shown schematically in FIG. 4. This circuit includes an energy source 50 which is connected with the coils 22 and 26 by conductor means containing a master switch 51 and a timer 52. The circuit of FIG. 4 further contains a time delay unit 53 which delays the starting of the motor 2 for a certain period of time following completion of the circuits of the coils 22 and 26. The setting of the timer 52 is such that, after the master switch 51 is closed, the coils 22 and 26 are energized for a certain interval of time including a first portion prior to starting of the motor 2 via time delay unit 53 and a second portion corresponding to the run-up stage of operation of the motor, i.e., for certain periods of time before and after the motor 2 is started via time delay unit 53. The timer 52 then opens the circuits of the coils 22 and 26 so that the filter 10 is not active while the motor 2 drives the shaft 3 at full speed, i.e., when the pump 1 is less likely to force contaminated liquid downwardly, through the clearance 7 and into the chamber 6 of the motor 2.

The circuit of FIG. 4 preferably further comprises additional switch means 55 which can complete the circuit of the coil 26 independently of the coil 22 so that the coil 26 can be energized while the operator opens the shutoff valve 31 to evacuate the impurities from the passage 24 between the holder 23 and core 20. Solid impurities which adhere to the holder 23 and to the adjacent portion of the external surface of the core 20 while the coil 22 is energized are free to descend with the liquid flowing into the drain pipe 30 as soon as the coil 22 is deenergized. At the same time, the coil 26 remains energized during that interval when the shutoff valve 31 is open so that the liquid which continues to flow into the region of zone 29 is relieved of impurities. In fact, it is not even necessary to open the valve 31 when the attendant desires to remove impurities from the passage 24. Thus, as soon as the coil 22 is deenergized while the coil 26 remains energized, contaminated liquid flows into the pipe 12 to be returned into the pump chamber 5 via channels 15*a*, 15 while some liquid continues to flow through the passage 28 (where it is relieved of impurities by the electromagnet including the energized coil 26) and into the pipe 11.

Referring again to FIG. 2, the reference character 9*a* denotes a valve, preferably a solenoid-operated valve, which is installed in the supply conduit 9 and is opened or closed by the timer 52 so that it is open only during those intervals when the electromagnets of the filter 10 are active.

The main purpose of the draining pipe 30 is to allow for total evacuation of all impurities from the container 10*a* when the submersible motor pump assembly is tested. The shutoff valve 31 in the pipe 30 is opened while the coil 26 is energized and the valve 9*a* is closed. This causes all of the liquid to flow from the pump chamber 5 into and from the container 10*a* via pipe 30. At the same time, the electromagnet including the coil 26 prevents penetration of solid impurities into the motor chamber 6 via clearance 7.

The improved submersible motor pump assembly takes advantage of the phenomenon that a pressure differential invariably develops not only during normal operation of the assembly but also during starting of the motor 2. Such pressure differential renders it possible to cause a stream of liquid to flow from the pressure side (discharge nozzle 8) of the pump 1 and through the filter 10 in such a way that flushing liquid which flows from the filter 10 enters the pump chamber 5 and prevents impurities from descending into the clearance 7 and thence into the motor chamber 6. Moreover, filtered liquid can enter the motor housing 2*a* to fill the space which becomes available as a result of compression of the aforediscussed remnants of air in the chamber 6, i.e., to fill that space which become available owing to compression of remaining air on starting of the pump 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A submersible motor pump assembly for circulation of a liquid which contains magnetizable solid impurities, comprising a pump having a casing with discharge means for pressurized liquid; a motor having a housing and including a rotary shaft arranged to drive said pump; a device defining with said shaft a clearance communicatively connecting the interior of said casing with the interior of said housing; and apparatus for preventing penetration of impurities from said casing into said housing via said clearance, including liquid conveying means defining a path for the flow of at least one stream of liquid from said discharge means into said clearance, and filter means provided in said path to intercept impurities in the stream of liquid entering said path so that said conveying means delivers to said clearance a stream of flushing liquid which is at least substantially free of impurities, said filter means comprising a magnetically operated filter adapted to attract and thus intercept magnetizable impurities in said path, and said magnetically operated filter including a container, and a plurality of electromagnets in said container, said electromagnets defining a series of passages for the flow of liquid from said discharge means toward said clearance so that each of said electromagnets can attract some magnetizable impurities during flow of liquid through the respective passage.

2. The assembly of claim 1, wherein said device has an internal surface spacedly surrounding said shaft intermediate said housing and said casing, said internal surface having a groove receiving flushing liquid from said path.

3. The assembly of claim 1, wherein said apparatus further includes means for returning directly into the interior of said casing a portion of liquid which is admitted into said path and contains intercepted impurities.

4. The assembly of claim 3, wherein said pump includes impeller means mounted on said shaft in the interior of said casing and said returning means of said apparatus is arranged to discharge liquid which is laden with impurities into the range of said impeller means so that the latter directs the returned liquid into said discharge means.

5. The assembly of claim 3, wherein said casing, said housing and said device together constitute a rigid enclosure, said conveying means and said returning means being integral parts of said enclosure.

6. The assembly of claim 1, wherein said electromagnets include a first electromagnet and a second electromagnet disposed downstream of said first electromagnet, as considered in the direction of flow of liquid from said discharge means toward said clearance, said container having an internal space including a region intermediate said first and second electromagnets, and said apparatus further comprising means for returning a portion of the liquid from said region directly into the interior of said casing, the remaining portion of liquid which is admitted into said region flowing through the passage defined by said second electromagnet and thence into said clearance.

7. The assembly of claim 1, further comprising means for energizing said electromagnets for a predetermined interval of time and for starting said motor with a predetermined delay following energization of said electromagnets, said interval including a first period preceding the starting of said motor and a second period following the starting of said motor, said motor requiring a given period of run-up time and such given period being equal to or approximating said second period.

8. The assembly of claim 7, wherein said energizing means comprises timer means.

9. The assembly of claim 1, further comprising means for energizing at least one of said electromagnets independently of each other electromagnet.

10. The assembly of claim 1, further comprising means for activating and deactivating said filter means, and valve means provided in said path upstream of said filter means and operative to admit liquid into said filter means while said filter means is activated.

11. The assembly of claim 10, wherein said valve means comprises a solenoid-operated valve.

12. The assembly of claim 1, wherein said container accumulates intercepted impurities, said container having a bottom portion and further comprising means for permitting evacuation of intercepted impurities through said bottom portion.

13. The assembly of claim 12, wherein said evacuation permitting means comprises a draining pipe connected with said bottom portion; and shutoff valve means provided in said pipe.

14. The assembly of claim 1, further comprising means for directing the liquid which enters said clearance toward the interior of said casing.

15. The assembly of claim 14, wherein said directing means comprises an external thread provided on said shaft.

16. The assembly of claim 14, wherein said device has an internal surface spacedly surrounding said shaft intermediate said casing and said housing, said directing means including a thread provided in said internal surface.

17. The assembly of claim 1, wherein said pump is disposed at a level above said motor and said shaft is substantially vertical.

18. The assembly of claim 1, wherein said device is at least in part constituted by a thermal barrier located between said casing and said housing.

* * * * *